United States Patent [19]

Curtiss

[11] 4,287,795

[45] Sep. 8, 1981

[54] ADJUSTABLE BLADE WRENCH

[75] Inventor: George R. Curtiss, Chardon, Ohio

[73] Assignee: The Rotor Tool Company, Cleveland, Ohio

[21] Appl. No.: 92,999

[22] Filed: Nov. 9, 1979

[51] Int. Cl.[3] ..... B25B 17/00

[52] U.S. Cl. ..... 81/57.26; 81/57.11; 81/57.3

[58] Field of Search ..... 81/57.26, 57.3, 57.29, 81/57.11, 57.12, 57.13, 57.14

[56] References Cited

U.S. PATENT DOCUMENTS

| | | | |
|---|---|---|---|
| 291,972 | 1/1884 | Atwood | 81/177.8 |
| 2,268,802 | 1/1942 | Coffman | 81/57.27 |
| 2,921,773 | 1/1960 | Hoelzer | 81/177.8 |
| 3,987,691 | 10/1976 | Savage | 81/57.3 |
| 3,987,692 | 10/1976 | Lesner et al. | 81/57.29 |
| 4,171,651 | 10/1979 | Dacunto | 81/57.29 |

*Primary Examiner*—James L. Jones, Jr.
*Attorney, Agent, or Firm*—Wilson, Fraser, Barker & Clemens

[57] ABSTRACT

A blade wrench includes an adjustable interconnection disposed between the tool body and the blade portion which permits selective angular positioning of the blade portion of the wrench relative to the tool body. The blade portion may thus be adjusted and fixed at a selected angle to facilitate alignment with and purchase on a fastener. The adjustable interconnection comprises apparatus for selectively angularly positioning the blade portion relative to the tool body and a locking device for maintaining this angular relationship.

4 Claims, 4 Drawing Figures

ADJUSTABLE BLADE WRENCH

BACKGROUND OF THE INVENTION

The invention relates generally to hand-held production tools and more specifically to such tools denominated blade wrenches which include a slender, arm-like structure having a power driven fastener engaging means adjacent its terminus.

Air and electrically powered hand-held production tools are indispensable components of high speed modern production lines such as are utilized in the automotive industry. In addition to their obvious advantages of speed and reduced operator fatigue, a major reason for their acceptance has been their adaptability to a multitude of production and assembly tasks. Specifically, torque indicating and limiting air powered fastener wrenches, tools for seating and permanently crimping fasteners, hog ringers for securing metal rings and clamps and reaction bar tools which prevent the reaction torque of a fastening operation from being transmitted to the tool operator are all representative of this adaptability.

The blade wrench is likewise a result of this adaptability and was developed in response to the requirement of tightening threaded fasteners in assembly locations where access and clearance along the axis of the fastener were limited. The blade wrench includes a conventional hand tool power train such as an electric or air driven motor and gear reduction unit. The output of the gear reduction unit drives a socket or other suitable fastener engaging means disposed within a thin, blade-like extension through a plurality of aligned idler gears. The socket rotates about an axis normal to the blade-like portion.

Typically, the thickness of the blade portion may be from three-quarters to seven-eighths of an inch and it thus may engage a bolt head spaced axially little more than this distance from an adjacent obstruction or be used to secure a nut to a captive bolt where the axial clearance between the end of the bolt and an adjacent obstruction is only slighter greater than the thickness of the wrench blade. The advantages of a blade wrench are particularly apparent in automotive production line use wherein clearances between seats and floors, door panels, fender wells, and the like may preclude utilization of conventional right-angle head pneumatic tools.

In the prior art, the blade portion of the blade wrench is rigidly secured to the tool body and extends along and is aligned with the axis thereof. Such an alignment facilitates positioning and engagement of the socket with the fastener by providing aligned visual reference points. In many specific fastening operations, however, the alignment of the blade portion and tool body poses problems which may render the tool either difficult or impossible to use. For example, such an alignment obviously maximizes the length of the tool and may cause interference with objects and structures at radial distances from the fastening less than the length of the tool. A more serious problem arises when the fastener to be manipulated is disposed in a blind, angled passage or in a location adjacent both axial and radial obstructions.

SUMMARY OF THE INVENTION

The instant invention is directed to a blade wrench having means for selectively positioning and securing the blade portion of the wrench at an angle relative to the body of the wrench. Specifically, the invention comprehends a substantially conventional right-angle head power tool and blade wrench assembly having a socket or fastener engaging means interconnected by a novel, adjustable linkage comprising spline or gear teeth means disposed in engageable relationship on complementary structures of the blade and tool head and demountable securing means permitting disassembly and radial adjustment of the blade portion relative to the tool body as well as maintenenace of the blade portion in a selected angular relationship relative to the tool body. The teeth means disposed on the tool body need not be an integral structure thereof but may be part of a collar which mounts on the right-angle head and is secured there by a clamp structure which engages the forward portion of the tool body. Such a configuration encourages and simplifies retrofitting of previously manufactured blade wrenches with the adjustable linkage according to the instant invention.

It is thus the object of the instant invention to provide a blade wrench having a blade portion adjustable to a selected angle relative to the body portion.

It is a further object of the instant invention to provide a blade wrench having a blade portion which may be simply and rapidly adjusted to a desired angle relative to the body portion of such blade wrench.

It is a still further object of the instant invention to provide an adjustable blade wrench mechanism which may be retrofit upon conventional blade wrench assemblies.

Further objects and advantages of the instant invention will become apparent by reference to the following specification and attached drawings.

DESCRIPTION OF THE PREFERRED EMBODIMENT

Figure 1:
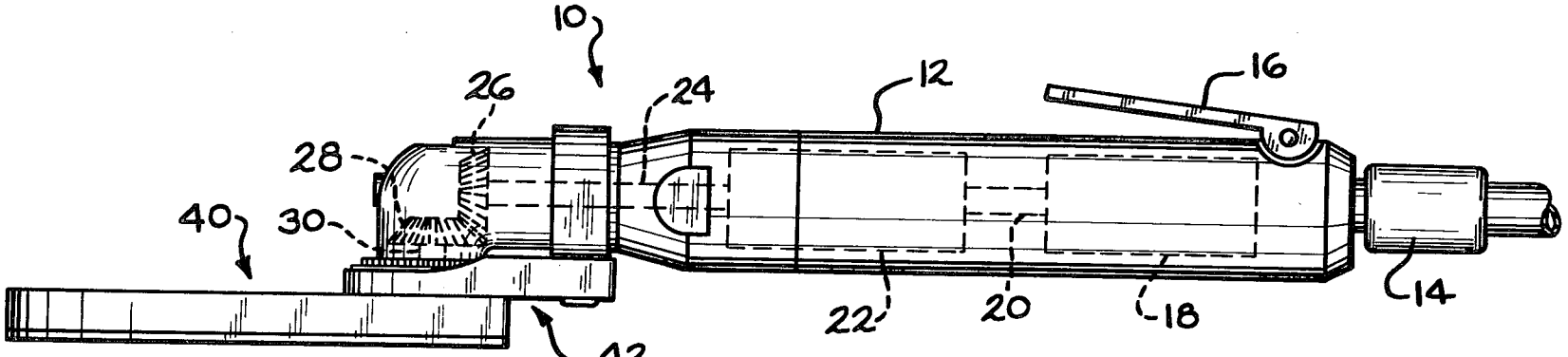
FIG. 1 is a side elevational view of a blade wrench according to the instant invention.
Figure 3:
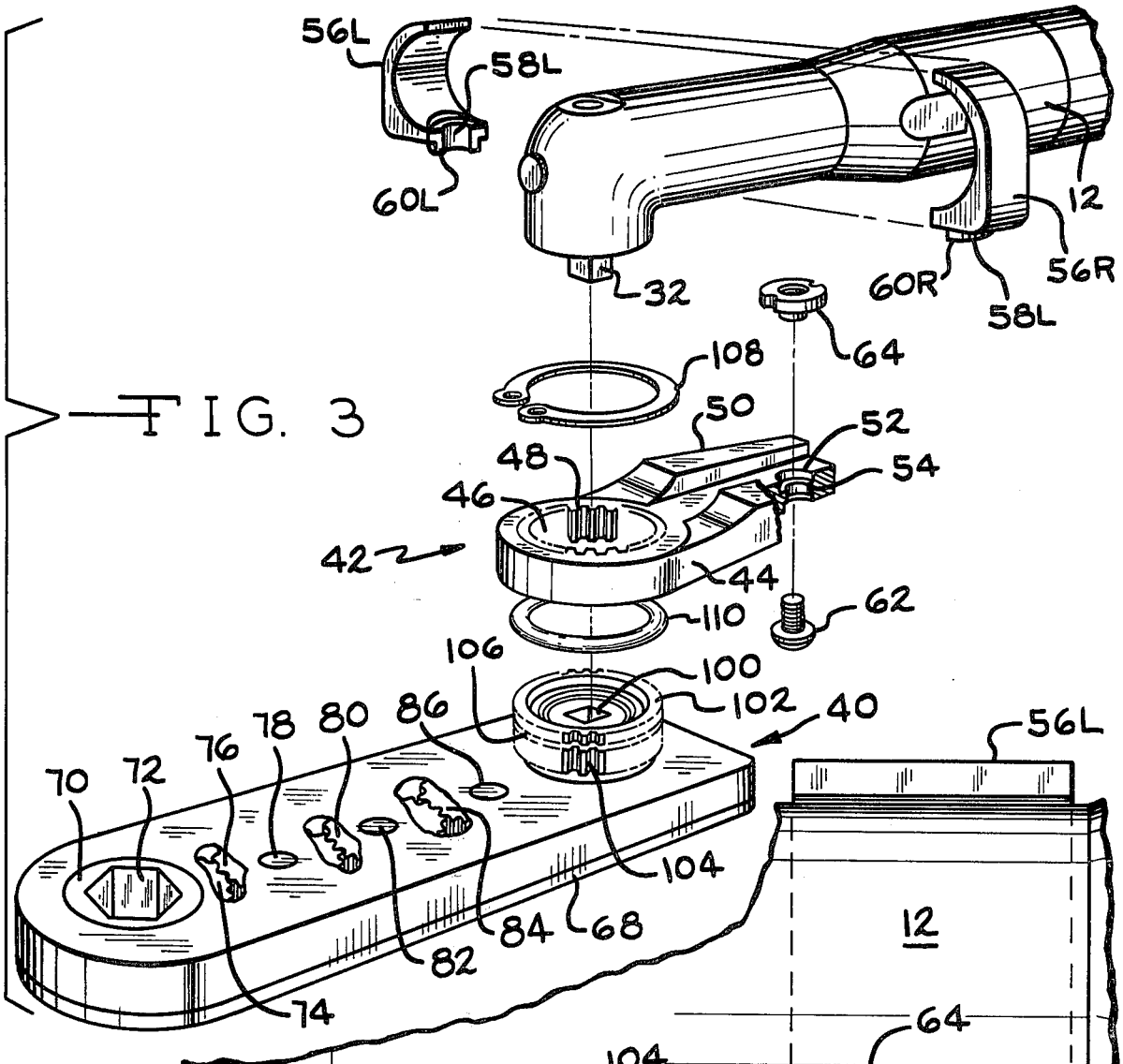
FIG. 3 is an exploded perspective view of the blade portion and right-angle head of a blade wrench incorporating the instant invention.

Referring now to FIGS. 1 and 3, an adjustable blade wrench according to the instant invention is generally designated by the reference numeral 10. The adjustable blade wrench 10 includes a generally elongate, cylindrical housing 12 which, in addition to providing protection and positioning to the other components of the adjustable blade wrench 10, also serves as a handle. At one end of the housing 12 is disposed an inlet fitting 14. The inlet fitting 14 is one of two components of a demountable interconnection to an air hose which supplies energy to the adjustable blade wrench 10 in the form of compressed air and, as such, includes a hollow passageway (not illustrated). Pivotally disposed on the housing 12 and oriented generally obliquely thereto is a spring-biased lever 16 which controls the flow of compressed air to an air motor 18 by opening and closing a control valve (not illustrated) mounted within the cylindrical housing 12. The air motor 18 is generally coaxially disposed within the cylindrical housing 12 and may be of the type generally denominated as a vane motor or any other suitable configuration. In accordance with conventional pneumatic wrench practice, the output of the air motor 18 is supplied through a stub shaft 20 to a speed reducing gear mechanism 22. A shaft 24 rotatably disposed within the housing 12 in suitable bearings (not illustrated) is connected to and drivingly mounts a first bevel gear 26. The first bevel gear 26 rotates about an axis generally parallel to or coincident with the axis of the cylindrical housing 12, is in constant mesh with and in turn transfers power to a second bevel gear 28 disposed for rotation about an axis generally perpendicular to that of the first bevel gear 26. The second bevel gear 28 is secured to a stub shaft 30 which terminates in an appropriate power transmitting fitting such as a square male shank 32, illustrated in FIG. 3. The just described components of the adjustable blade wrench 10 represent the rotary energy generation and delivery means typical of such air powered production hand tools. As such, the components disposed on and within the housing 12 are merely representative of the equipment with which the indexable mechanism and blade wrench itself may be utilized and the instant invention should not be construed to be limited thereby.

Figure 2:
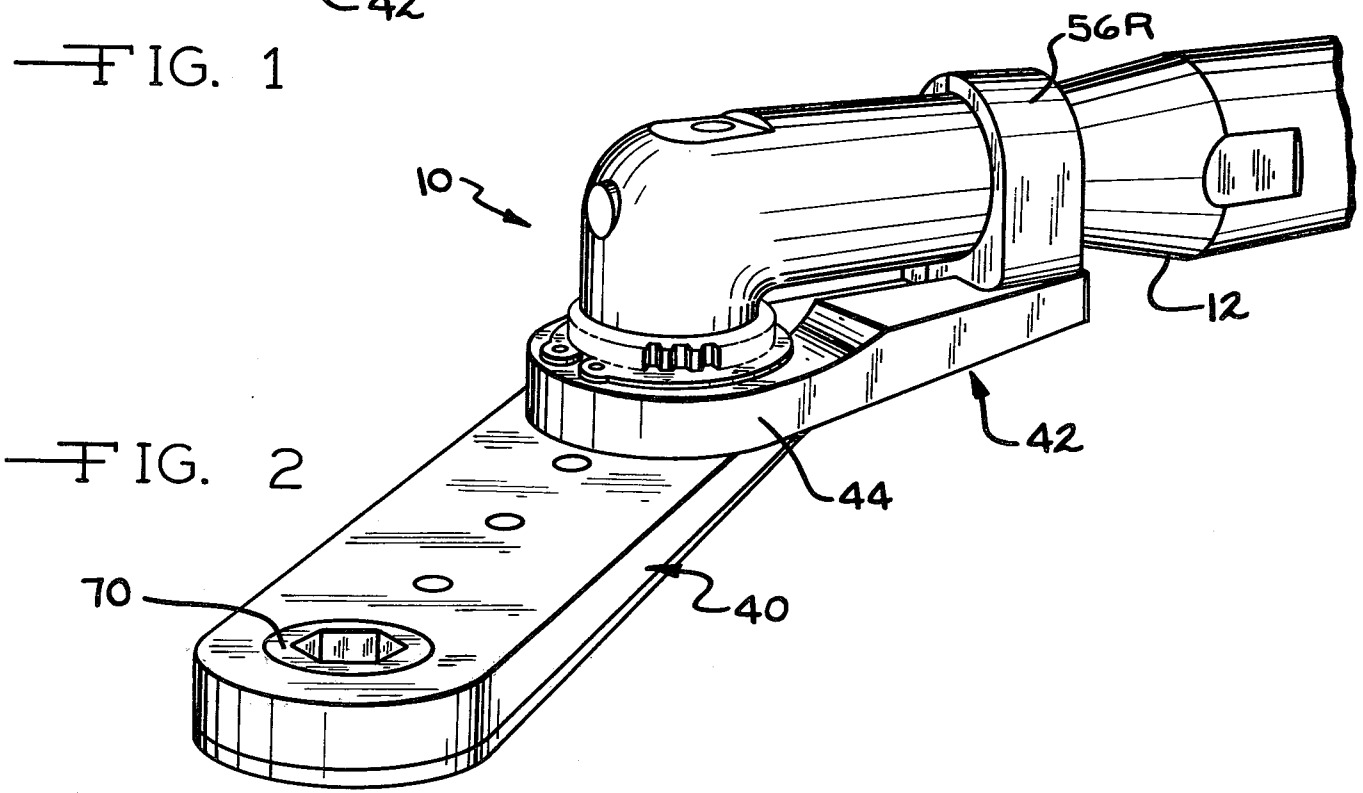
FIG. 2 is a fragmentary perspective view of a blade wrench according to the instant invention with the blade portion positioned at an oblique angle relative to the body of the blade wrench.

Referring now to FIGS. 2 and 3, the blade wrench 10 further includes an adjustable blade assembly 40 and a securable collar assembly 42. The securable collar assembly 42 includes a carrier 44 which defines an opening 46 having splines or spur gear type teeth 48 disposed about its inner surface. The carrier 42 further includes a channeled plate portion 50 which extends unidirectionally from the opening 46. The plate portion 50 defines an opening 52 having an axis generally parallel to the axis of the opening 46 and spaced therefrom. Concentrically disposed about the opening 52 on the upper surface of the plate portion 50 is a counterbored opening which defines a recessed, circumferential shoulder 54. A pair of left and right, mirror-image clamps 56L and 56R include semi-circular openings 58L and 58R and semi-circular sleeve-like projections 60L and 60R. The sleeve-like projections 60L and 60R seat within the counterbored opening adjacent the recessed circular shoulder 54 and clamp the neck portion of the housing 12, inhibiting rotation and movement of the securable collar assembly 42 relative to the housing 12. The pair of clamps 56L and 56R are retained there by a threaded fastener 62 and a captive nut 64 having anti-rotation means (not illustrated).

The adjustable blade assembly 40 is of substantially conventional construction and is preferably fabricated of a hollow frame 66 closed by a lower plate 68 which is secured to the frame 66 by suitable fasteners such as machine screws (not illustrated). The hollow frame 66 and lower plate 68 both define suitable aligned openings for bearings, shafts and the like which are contained within the frame 66. At one end of the indexable blade assembly and rotatably positioned in a pair of the just described openings is a socket 70. The socket 70 preferably defines an internal hexagonal, flatted surface 72 compatible with conventional threaded fasteners.

About the periphery of the socket 70 are disposed spur gear teeth 74 which mesh with the teeth of an adjacent idler gear 76. The idler gear 76 is disposed upon a stub shaft 78 which may be integrally formed with the spur gear 76 and which is rotatably disposed within aligned openings in the frame 66 and the plate 68. The idler gear 76 meshes with a second idler gear 80. The idler gear 80 likewise includes shaft stubs 82 which may be integrally formed with the idler gear 80 and are rotatably disposed within aligned openings in the frame 66 and the plate 68. In turn, the idler gear 80 meshes with a third idler gear 84 again having shaft stubs 86 rotatably disposed within aligned openings of the frame 66 and the plate 68. The third idler gear 84 meshes with a spur-type drive gear 88 which is rotatably mounted and positioned by a pair of anti-friction bearings 90A and 90B. The anti-friction bearing 90A is retained in position by a snap or C-ring 92 and the anti-friction bearing 90B is likewise retained by a snap ring 94 which seats in a stub shaft 96 frictionally retained in an opening 98 within the plate 68. The drive gear 88 defines a centrally disposed socket 100 of suitable dimensions such that it snugly receives the square shank 32 extending radially outwardly from the housing 12. Engagement of the square shank 32 into the socket 100 thus permits the transmission of rotary energy from the air motor 18 through the gear mechanism 22 and the pair of bevelled gears 26 and 28 to the drive gear 88, through the idler gears 84, 80, 76 and to the socket 70.

The blade 44 also includes an upwardly extending cylindrical projection 102 which is disposed about the drive gear 88. The outer circumferential wall of the cylindrical projection 102 defines a plurality of splines or male spur-type gear teeth 104. The gear teeth 104 are equal in number to and appropriately sized and spaced such that they axially mesh with and engage the spur gear teeth 48 disposed in the opening 46 of the securable collar 42. An inwardly directed annular groove 106 is formed in the gear teeth 104 and encircles the cylindrical projection 102 adjacent its upper end. A resilient snap or C-ring 108 seats within the annular groove 106. A spacing and anti-friction washer 110 is preferably disposed between the head of the housing 12 and the drive gear 88.

Figure 4:
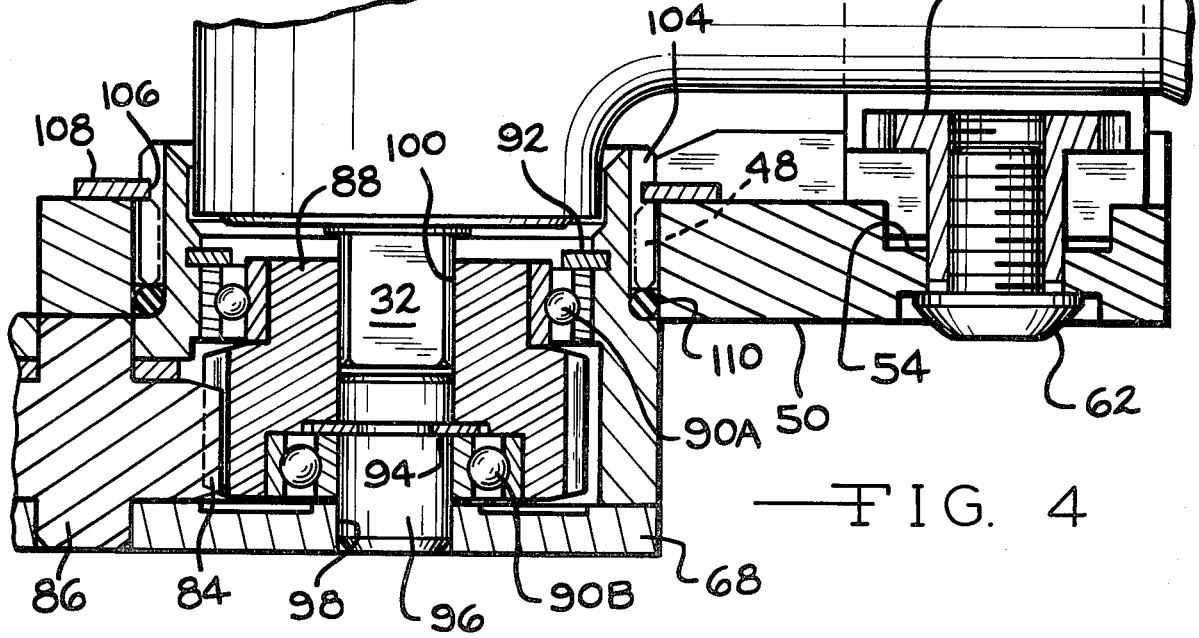
FIG. 4 is an enlarged, fragmentary, sectional view of a blade wrench according to the instant invention taken along line 4—4 of FIG. 3.

Operation and adjustment of the adjustable blade wrench 10 is straightforward. As illustrated in FIGS. 1, 3, and 4, compressed air is supplied to the wrench 10 through the inlet fitting 14. The spring-biased lever 16 controls the flow of compressed air to the air motor 18 in a conventional fashion, i.e., when the spring-biased lever 16 is moved toward the housing 12, a control valve opens and supplies compressed air to the air motor 18 and vice versa. The air motor 18 supplies rotary power to the speed reducing gear mechanism 22 which in turn drives the first bevel gear 26 through the shaft 24. The second bevel gear 28 is in constant mesh with the first bevel gear 26, receives power therefrom and rotates on an axis generally perpendicular to that of the cylindrical housing 12. Rotary power is then transferred from the stub shaft 30, through the square shank 32 and the socket 100 engaged thereabout to the spur-type drive gear 88. From the drive gear 88 power is transferred through the train of idler gears 84, 80, and 76 to the spur gear teeth 74 disposed about the periphery of the socket 70. The socket 70 includes the flatted surface 72 which may be an appropriate English or metric sized opening to engage a conventional hex-head fastener.

Should a specific production line task or structure require it, the angular relationship between the cylindrical housing 12 and the adjustable blade assembly 40 may be easily adjusted. To achieve such adjustment, the C-ring 108 is removed from the annular groove 106. Such removal permits withdrawal of the cylindrical projection 102 from the opening 46 and disengagement of the gear teeth 104 from the gear teeth 48. The angular relationship between the blade assembly 40 and the housing 12 may then be adjusted in increments determined by the number of meshing teeth 48 and 106. For example, it has been found that the utilization of forty-seven gear teeth in the opening 46 and on the projection 102 provides an indexing increment of approximately 7.7° as well as providing suitable strength at the indexable interconnection. A greater number of teeth will, of course, provide smaller increments of indexing capability.

Furthermore, it should be understood that other interconnecting configurations such as radially cut face gear teeth, frusto conical wedges, and breech locks which provide either incrementally or infinitely adjustable positioning of the blade relative to the housing may be utilized to practice the instant invention. Once the relative angular position between the blade assembly 40 and the housing 12 has been selected, the components of the blade wrench 10 may be reassembled in reverse order from that just described.

It should be appreciated that a major advantage of an adjustable blade wrench according to the instant invention is the capability of retrofitting previously manufactured blade wrenches with a minimum of substitution of new parts. Specifically, a securable collar assembly having a structure for adjustably receiving a blade assembly simply and rapidly attaches about the head of a cylindrical housing of a conventional blade wrench by means of a retaining structure. The retaining structure need not be sized for tight circumferential engagement of the neck of the housing but may define an opening somewhat larger than that of the housing neck in order to seat properly over the necks of housings having limited though finite range of variation. Retrofitting of existing equipment further includes providing an adjustable blade assembly having a complementary structure for engagement with the blade receiving structure on the collar. Thus, by the addition of a securable collar assembly having blade receiving means and replacement of the blade assembly with an adjustable blade assembly having a complementary engaging means, retrofitting of fixed blade wrench tools with adjustable blades according to the instant invention may be accomplished.

The foregoing disclosure is the best mode devised by the inventor for practicing this invention. It is apparent, however, that devices incorporating modifications and variations to the instant invention will be obvious to one skilled in the art of wrenches. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. A wrench apparatus comprising, in combination, a housing, means for providing rotary motion disposed within said housing, a blade structure having means for engaging and rotating a fastening device, means for transferring rotary motion from said means for providing rotary motion to said means for engaging and rotating a fastening device, a coupling member disposed generally between said housing and said blade structure, said coupling member having clamp means engaging said housing for removably securing said member to said housing, said coupling member and said blade structure including mating means for providing adjustment of the angular relationship between said blade structure and said coupling member over a full circle and locking means for maintaining such angular relationship.

2. In a blade wrench having a generally elongate housing containing a means for providing rotary power operably linked to a speed reduction mechanism and a blade having a rotatable socket driven by a train of idler gears, the improvement comprising an adjustable interconnection between said housing and said blade, said adjustable interconnection including a demountable carrier having means for providing selective securement to said housing, mating means disposed on said carrier and said blade for providing relative angular adjustment between said housing and said blade, said mating means including a splined opening defined by said carrier and a splined cylindrical projection on said blade, and locking means for maintaining a relative angular position between said housing and said blade whereby said splines may be selectively engaged and locked to prevent relative rotation between said carrier and said blade.

3. The improvement of claim 2 wherein said locking means includes an annular groove disposed in one of said mating means and a retaining washer removably seated in said groove.

4. The improvememnt of claim 2 wherein said means for providing selective securement to said housing includes clamp means securable to said carrier for positioning about said housing of said blade wrench.

* * * * *